US005930563A

United States Patent [19]

Reichl et al.

[11] Patent Number: 5,930,563

[45] Date of Patent: Jul. 27, 1999

[54] DEVELOPER STATION WITH A PLURALITY OF ADJACENT DEVELOPER CHAMBERS

[75] Inventors: Helmut Reichl, Fürstenfeldbruck; Manfred Neufeld, Baierbrunn; Michael Müller, München, all of Germany

[73] Assignee: Oce Printing Systems GmbH, Poing, Germany

[21] Appl. No.: 09/065,054

[22] PCT Filed: Jul. 2, 1996

[86] PCT No.: PCT/DE96/01176

§ 371 Date: Jun. 26, 1998

§ 102(e) Date: Jun. 26, 1998

[87] PCT Pub. No.: WO97/16770

PCT Pub. Date: May 9, 1997

[30] Foreign Application Priority Data

Oct. 27, 1995 [DE] Germany ..... 195 40 138

[51] Int. Cl.[6] ..... G03G 15/08

[52] U.S. Cl. ..... 399/119; 399/384

[58] Field of Search ..... 399/119, 223, 399/231–233, 228, 229, 384, 385, 401; 222/DIG. 1

[56] References Cited

U.S. PATENT DOCUMENTS 4,616,919 10/1986 Adley et al. .

4,706,099 11/1987 Suzuki ..... 399/385

5,166,731 11/1992 Aimoto et al. .

FOREIGN PATENT DOCUMENTS 29 35 670 C2 4/1979 Germany .

81 14 468 U 5/1981 Germany .

WO 94/03842 2/1994 WIPO .

WO 94/27193 11/1994 WIPO .

OTHER PUBLICATIONS

Japanese Patent Abstract, Publication No. JP60015659, Publication Date Jan. 26, 1985.

*Primary Examiner*—Arthur T. Grimley
*Assistant Examiner*—Quana Grainger
*Attorney, Agent, or Firm*—Hill & Simpson

[57] ABSTRACT

The invention relates to a developer station for electrophotographic printing apparatus operating in multicolor simplex and duplex mode and having continuous paper. The developer station contains a plurality of adjacent developer chambers with developer drums and transport drums arranged within. The adjacent developer chambers are separated by partition walls with openings though which the drums pass. The drums driven together are positively connected with each other by coupling elements arranged in the area of the openings and having associated toner-proof seals.

20 Claims, 7 Drawing Sheets

FT
6
TFW
10
12
DW
10
22
22
23
10
W1
14
15
W2
13
TW
ZW
10
6
44
43

DEVELOPER STATION WITH A PLURALITY OF ADJACENT DEVELOPER CHAMBERS

FIELD OF THE INVENTION

The invention relates to a developer station for a printer or copier device for separate inking of a plurality of developer regions with toner that are arranged side-by-side on an electrographic intermediate carrier.

BACKGROUND OF THE INVENTION

WO 94/27193 discloses an electrographic printer means with which it is possible to print a web-shape recording medium in multiple colors in both simplex and duplex mode. To this end, the printer means contains a plurality of developer stations arranged following one another or side-by-side to one another that separate ink the developer regions allocated to the developer stations on an electrographic intermediate carrier (photoconductor).

In multi-color simplex mode, what is referred to as the spot color mode, a print image having a first color is first transfer-printed onto the recording medium, the print image is then fixed and the recording medium is then resupplied to the transfer printing station, and a print image is then printed with a second color and is subsequently fixed in a second task through the fixing station. The transfer printing station is thus traversed by a single recording medium in two recording medium webs arranged parallel and side-by-side. Corresponding developer regions on the photoconductor are allocated to the recording medium webs. Since photoconductors, whether they are bands or drums, cannot be arbitrarily wide, it is necessary to arrange the developer region in a side-by-side fashion on the photoconductor without significant spacing. The appertaining developer stations would thus also have to be arranged side-by-side and in close proximity. This can be managed only with difficulty with separate developer stations with separate drives for the drums. Further, an exact adjustment of the developer stations is required.

When a single developer station having a plurality of separate developer chambers is employed according to the present invention, then it is necessary to keep the partitions extremely thin. This produces sealing problems in the region of the partitions.

SUMMARY OF THE INVENTION

An object of the present invention is to offer a compact, dependable developer station having a plurality of developer chambers arranged side-by-side and sealed toner-tight to prevent migration of toner between developer chambers.

This object is achieved according to an embodiment of the present invention wherein a developer station is provided which comprises at least two developer regions disposed side-by-side on an electrographic intermediate carrier. The developer station further comprises at least two developer chambers including a left developer chamber and a right developer chamber arranged in a side-by-side fashion and in alignment with one of the developer regions. Each developer chamber includes a developer drum and a transport drum. The developer drums of each chamber being connected by a first coupling element and the transport drums of each chamber being connected by a second coupling element. The developer chambers being separated by a partition. The partition includes a first opening for accommodating the first coupling element and a second opening for accommodating the second coupling element. The first and second coupling elements being sealed against the partition by first and second seals respectively.

In an embodiment, the developer drums each comprise a hollow drum that is connected to a magnet stator. The left and right hollow drums being connected by the first coupling element which comprises a tubular connecting member that passes through the first opening and connects the two hollow drums together.

In an embodiment, the tubular connecting member is threadably connected to each hollow drum.

In an embodiment, the tubular connecting member is threadably connected to each hollow drum.

In an embodiment, the tubular member further comprises an inside running surface which engages a plurality of radial seal elements which isolate the opposing ends of the tubular connecting member and prevent the migration of toner through the tubular connecting member.

In an embodiment, the inside running surface of the tubular connecting member is fabricated from an abrasion-resistant metal.

In an embodiment, a radial shaft seal is disposed within the tubular connecting member which includes a plurality of elastic seal lips that seal against the inside running surface of the tubular connecting member and prevent the migration of toner therethrough.

In an embodiment, the first seal further comprises a layer of elastic material disposed between the first coupling element and an acceptance region of the first opening of the partition.

In an embodiment, the first seal comprises a radial seal comprising Teflon felt.

In an embodiment, the developer drums are coaxial.

In an embodiment, the transport drums are coaxial.

In an embodiment, the second seal which seals the second coupling element connecting the transport drums together to the partition comprises a seal bearing mounted around the second coupling element and between the second coupling element and the second opening of the partition.

In an embodiment, the second coupling element comprises an axle and the second seal further comprises a central collar disposed between a pair of spring washers which are, in turn, disposed between a pair of rolling bearings. The rolling bearings are disposed between a pair of seal rings which provide a seal between the axle and an outer bearing member that engages the opening of the partition.

In an embodiment, the outer bearing member of the second seal is secured against rotation by an anti-rotation element which connects the outer bearing member to a longitudinal guide which, in turn, is connected to a stationary housing.

In an embodiment, the developer further comprises left and right dosing drums, which are disposed downstream of the left and right developer drums. The partition separates the left and right dosing drums which are connected by a third coupling element that passes through a third opening in the partition. The third coupling element is sealed against the third opening by a third seal which prevents migration of toner through the third opening.

In an embodiment, a common drive system is provided for all drums of the developer station.

Advantageous embodiments of the invention are identified in the subclaims.

The inventive developer station contains a plurality of developer chambers arranged side-by-side respectively allocated to the developer regions and having developer drums and transport drums arranged therein. Partitions arranged in the boundary region between neighboring developer chambers comprise through drum openings. Neighboring drums are coupled to one another with a positive lock via coupling elements in the region of the through drum openings and are respectively driven in common. Seals in the region of the through drum openings seal the developer chambers from one another and are toner-tight.

In order to enable easy cleaning of the transport drums, the transport drums of the individual developer chambers can be removed in common from the station housing and re-introduced in turn.

The inventive developer station is compact and dependably constructed and is particularly suitable for employment in an electrographic printer means disclosed by WO 94/27193.

Other objects and advantages of the present invention will become apparent from reading the following detailed description and appended claims, and upon reference to the accompanying drawings.

BRIEF DESCRIPTION OF THE DRAWINGS

Embodiments of the invention are presented in the drawings and are described in greater detail below with reference to the drawings, by way of example. Shown are.

Figure 1:
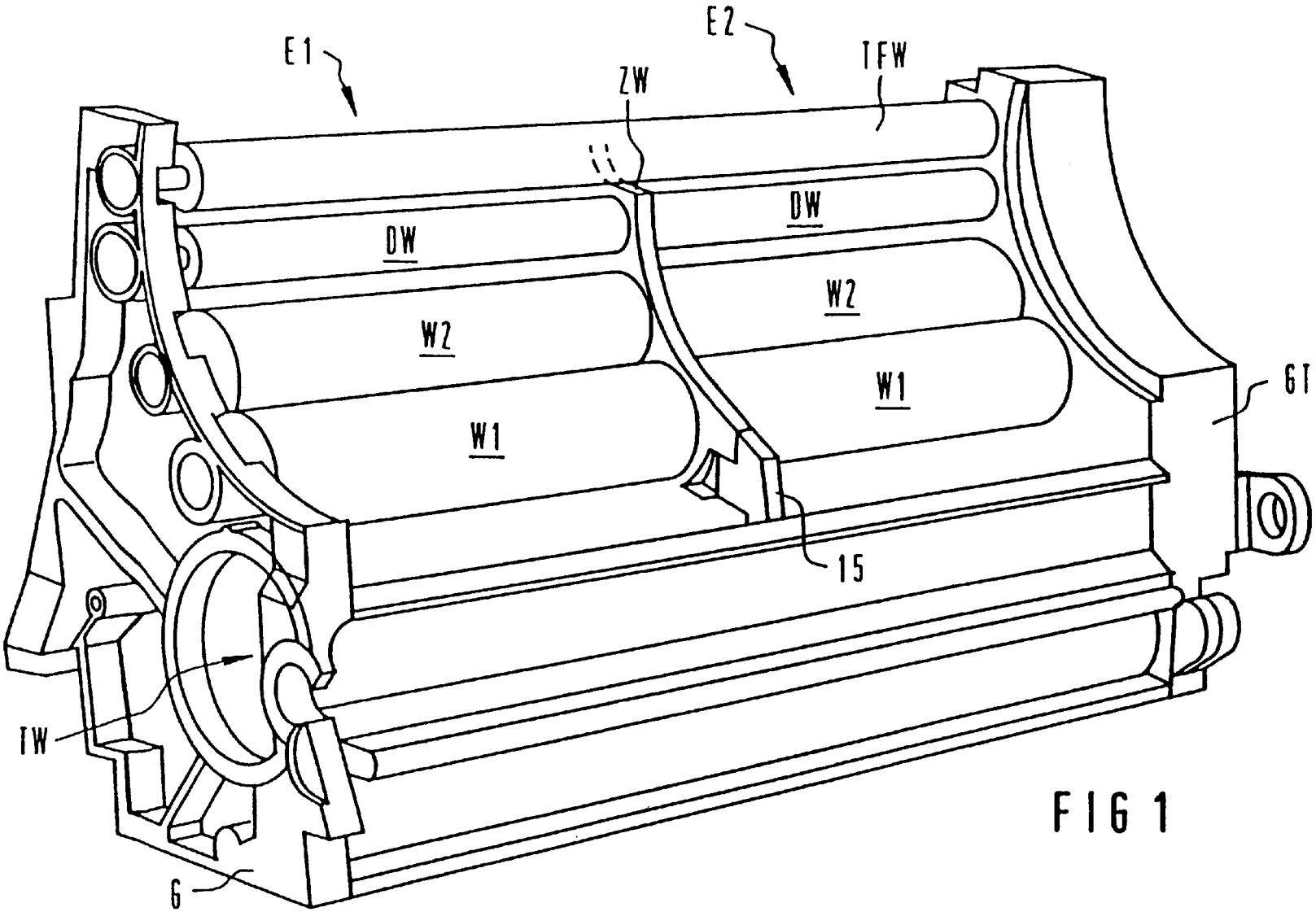
FIG. 1 is a schematic illustration of a developer station having two developer chambers arranged side-by-side.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

An electrophotographic printer means for multi-colored printing of web-shaped recording media in simplex and duplex mode, as disclosed by WO 94/27193, contains a developer station that is described in detail below with reference to the drawing. It is fundamentally composed of two developer stations separated by a thin partition and coupled to one another across the partition, these respectively having a functional structure fundamentally known from WO 94/03842. The function of the drums participating in the developing process and their technical characterization is disclosed in WO 94/03842. In this respect, this publication is a component part of the present disclosure and is hereby incorporated by reference.

The developer station shown in FIG. I contains a housing G arranged in the apparatus removable via rails and having two developer chambers E1 and E2 that are separated via a partition ZW. Two developer drums W1 and W2 composed of a rotatable hollow drum HW with magnet stator MS (FIG. 4) arranged therein as well as a dosing drum DW of plexiglass with illumination means arranged therein are respectively arranged in the developer chambers E1 and E2. A transport drum TW (FIG. 5) seated under the developer drums in the developer sump transports the developer mix to the developer drums W1 and W2. A single carrier capture drum TFW spanning the developer chambers E1 and E2 is arranged outside the developer chambers E1 and E2 in the exit region of the developer station, this carrier capture drum TFW being constructed analogous to the developer drums. All drums except the transport drum are grouped around a photoconductor drum FT (FIG. 2) corresponding to the course of the developer gap. They rotate in the arrow directions shown in FIG. 2. They are driven in common via a gearing GT laterally arranged at the housing G of the developer station.

Partition

The partition ZW (FIG. 2) separates the differently colored developer mixes (for example, two-component toner). In order to prevent arc-overs due to a bias voltage, it is composed of plastic having an anodized layer of aluminum with rounded corners so that the anodized layer does not peel off. It is also possible to fabricate it entirely of a non-magnetic material, for example aluminum. The partition ZW contains through-drum openings 10 respectively allocated to the drums, whereby the neighboring drums of the developer chambers are coupled positively and locked to one another via coupling elements 11 (FIGS. 4, 5) in the region of the through-drum openings and are respectively driven in common. The seals that seal the developer chambers from one another are also located in the region of the through-drum openings 10.

Figure 2:
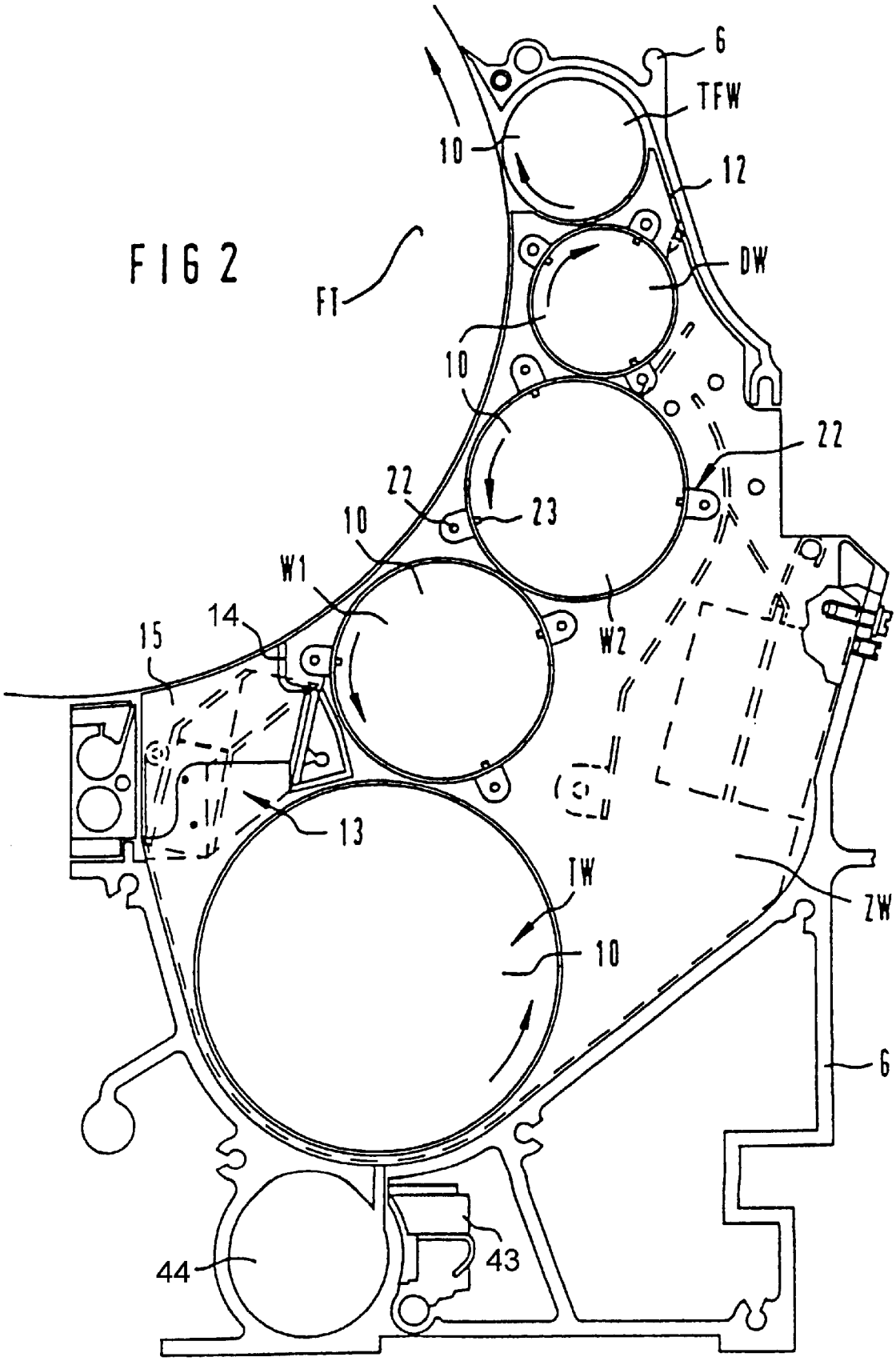
FIG. 2 is a schematic illustration of the arrangement of a partition between the developer chambers.
Figure 3:
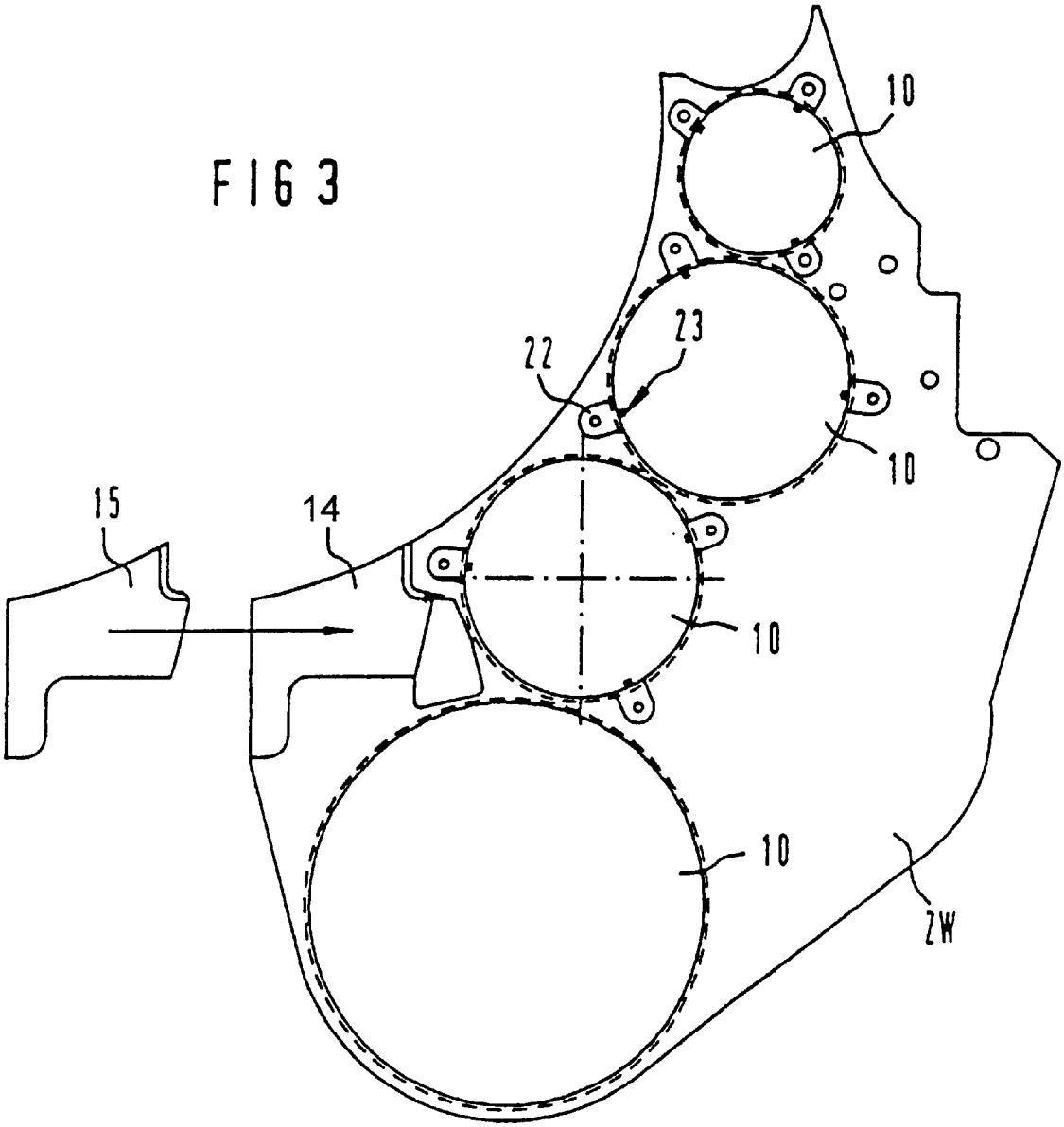
FIG. 3 is a schematic illustration of the partition between the developer chambers.

As shown in FIGS. 2 and 3, the partition ZW comprises the parting regions of the drums. A partition is not necessary around the carrier capture drum TFW because the mix transport only ensues up to the developer drum W2 (adjoining the dosing drum DW), as seen from bottom to top to the exit region of the developer station. The carrier capture drum TFW is therefore fashioned one piece and is only partially encompassed by the partition ZW. It is sealed toward the housing G via a seal 12 of cellular material (FIG. 2). In the region of a mix guide element (doctor blade) 13 extending along the transport drums TW, the partition ZW contains an opening 14 that accepts the doctor blade 13. This opening 14 is closed with a seal via a filler member 15 (FIG. 3) after the installation of the partition and the drums. A continuous, undivided doctor blade 13 can thus be employed for the entire developer station. The filler member 15 is roof-shaped so that no agglomerations of mix arise or, respectively, so that the mix can flow off in this flat part of the partition ZW. The distance of the partition ZW from the photoconductor drum FT is critical. A distance of 1 mm has proven itself. Potentially occurring, slight migrations of mix in this region do not deteriorate the function.

It is also possible to assemble the partition ZW of two mirror-symmetrical parts with enclosed air channels via which blown air is brought to the boundary region to the photoconductor drum in order to thus prevent a deposit of toner dust or mix in this region. Further, for example a Teflon felt seal or the like can be arranged between photoconductor drum FT and partition ZW.

Figure 4:
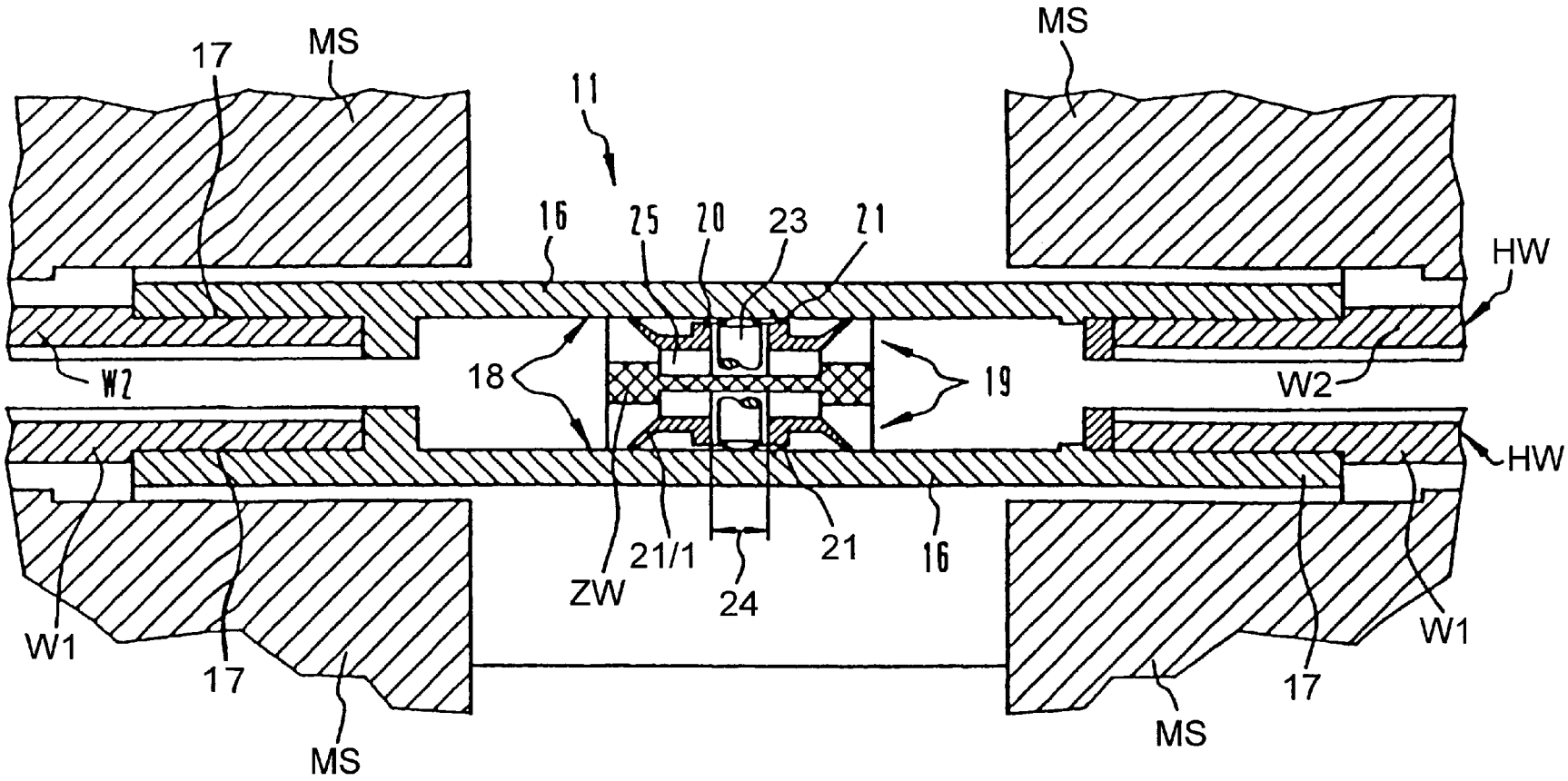
FIG. 4 is a schematic, cross-sectional view of the coupling of the developer drums and their sealing in the region of the through drum opening.

As shown in FIG. 4, the hollow drums HW of the developer drums W1 and W2 are connected to one another via a tubular adapter 16. The adapter 16 comprises a tubular connector member coupling the hollow drums HW that has lateral acceptance regions 17 for the acceptance of the ends of the hollow drums. The adapter is screwed to the ends of the hollow drums HW in these acceptance regions 17. The inside diameter of the adapter 16 is dimensioned such that the magnet stators MS can be inserted into them when the developer drums are mounted. The magnets allocated to the magnet stators MS are interrupted in the region of the partition ZW so that no mix is attracted there. In the region of the partition ZW, the adapter 16 comprises a running surface 18 as seating surface for seal elements 21/1 of a radial seal 19 allocated to the through drum openings. The adapter 16 and, thus, the running surface 18 is preferably composed of an abrasion-proof material, for example, nitrocarbonated Cr—Ni steel, chrome-plated brass or hard-anodized aluminum.

The dosing drums DW are also analogously connected positively locked via an adapter 16 with running surface 18. Like the dosing drum member, it is composed of plexiglass or of some other suitable material.

In order to seal the through-drum openings 10 from the coupling elements 11 of the developer and dosing drums, these contain a radial shaft seal 19 shown in section in FIG. 4. Due to the slight spacings of, in particular, the developer drums W1 and W2, it must be extremely flat. The radial shaft seal 19 is composed of a seal member 20 torsionally secured in the through-drum openings, this seal member 20 comprising an inside circumferential surface 21 centering the seal on the coupling elements 11 (adaptors 16) having lateral, elastic seal lips 21/1 that elastically against the running surfaces 18 of the adaptors 16. The seal is centered on the adapter 16 via the diameter of the inside circumferential surface 21 so that identical conditions such as, for example, constant pressing power always prevail at the sealed location. The seal is torsionally secured via filler members 22 insertable into recesses of the partition and having pins 23 arranged therein that engage into openings 24 of the seal. When mounting the partition ZW, the filler members 22 are first put in place with the pins 23 on the seal and are then inserted into the recesses of the partition with the seal. The outside diameter of the seal is sealed with cellular material 25 in the through-drum openings of the partition and at the filler members. The seal body 20 is composed of tested Teflon material with fillers. Given an appropriate selection of materials, for example Teflon felt, it is also conceivable to fashion the radial shaft seal as a felt ring overall.

Transport Drums

Figure 5:
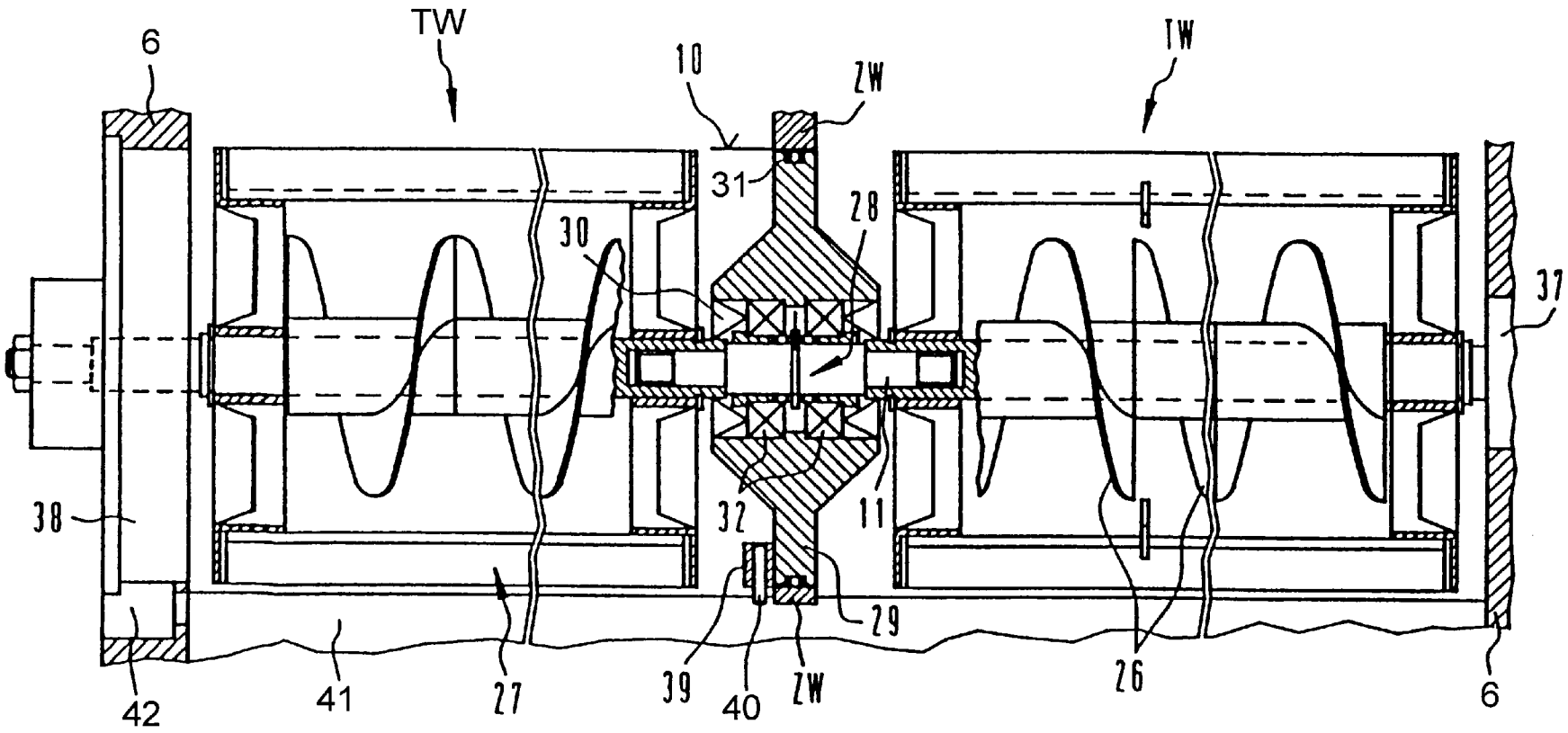
FIG. 5 is a schematic illustration of the coupling of the transport drums and their sealing and bearing in the region of the through drum opening.
Figure 7:
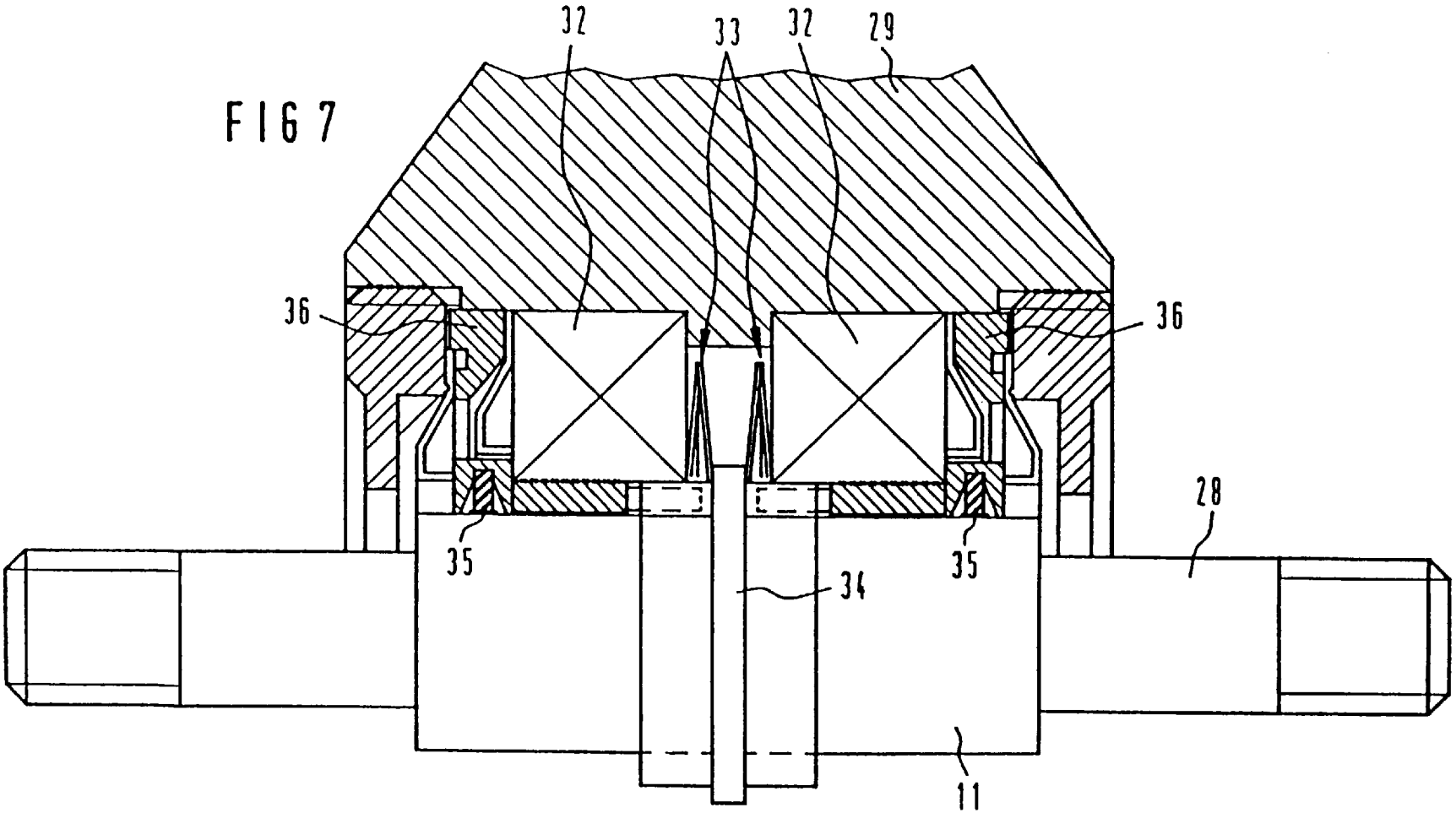
FIG. 7 is a schematic illustration of the sealed bearing of the transport drum.

As can be seen from FIG. 5, the developer station contains a respective transport drum TW in the developer station sump of the developer chambers, this transport drum TW having a central transport helix 26 for the transverse blending of the developer mix and having radial paddles 27 arranged at the circumference that transport the developer mix to the developer drums W1, W2. In the region of the through-drum opening of the partition ZW, the rotational axes of the transport drums TW are connected positively locked to one another via the coupling element 11 fashioned as a full floating axle 28. At the same time, the full floating axle 28 is part of a bearing assembly having a bearing member 29 that comprises a central, sealed bearing 30 that accepts the rotational axis of the transport drums TW. The disk-like bearing member 29 is arranged in the through-drum opening 10 of the partition ZW and is sealed therein via a seal ring 31 having, for example, the form of an O-ring or is sealed with cellular material. The sealed bearing 30 is an improvement of what is referred to as the "Nilos seal" disclosed by German Utility Model G8114468.7. It contains two rolling bearings 32 (FIG. 7) arranged in a bearing cage of the bearing member 29 that respectively have their insides supported via Belleville spring washers 33 on a central collar 34 of the coupling element (full floating axle 28) and respectively have their outside lying against a seal ring 35 (Nilosring) that seals the bearing from the developer chambers. The seal ring 35 is secured via a lock and cover ring 36. The interaction of the bearing elements for achieving the sealing function is fundamentally disclosed by German Utility model G8114468.7.

Figure 6:
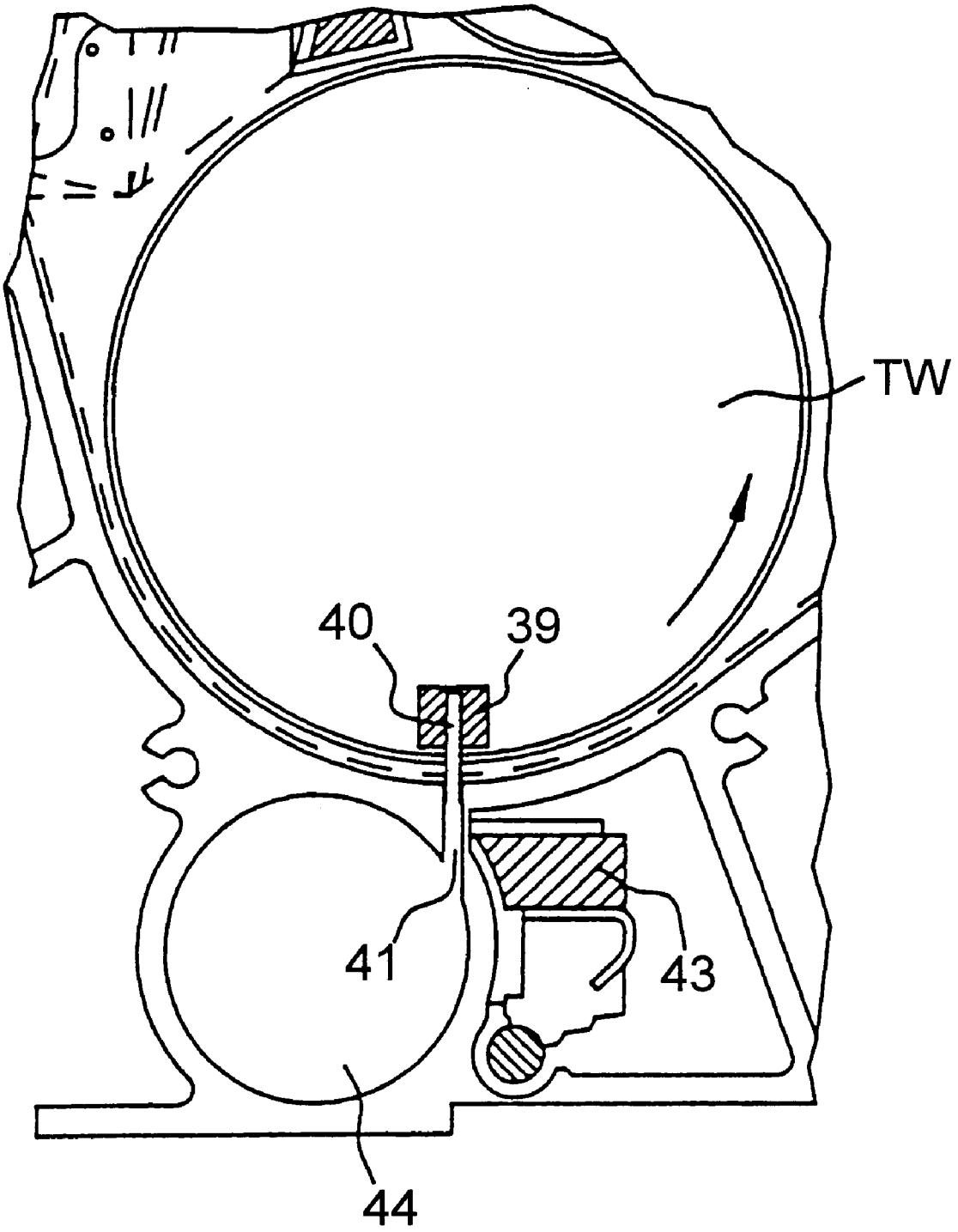
FIG. 6 is a schematic, partial view of the partition securing for the sealed bearing of the transport drum.

The transport drums TW are coupled via the coupling element 11 to form a transport drum assembly (FIG. 5) that is seated at both sides such in the developer station housing G so that the transport drum assembly can be removed from the developer station housing G as a closed unit and can in turn be reintroduced to the housing. To this end, the transport drum assembly is seated in a moveable bearing 37 at the drive side and in a removable fixed bearing 38 at the servicing side. As seen in FIGS. 5 and 6, an anti-rotation element 39 having a pin 40 that engages into a longitudinal guide 41 of the station housing G is secured to the bearing member 29. The longitudinal guide 41 (slot) extends in the left-hand developer chamber from the partition ZW into the region of the fixed bearing 38, where it discharges toward the outside. A projection 42 of the fixed bearing 38 closes the opening. The guide slot 41 is part of an emptying channel 44 for the developer mix that can be closed via a pivotable permanent magnet 43.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

We claim:

1. A developer station for a printer or copier device for a separate inking of at least two developer regions with toner, the separate developer regions being arranged side-by-side on an electrographic intermediate carrier, the developer station comprising:

at least two developer chambers and including a left developer chamber and a right developer chamber arranged side-by-side, each of said developer chambers being in alignment with one of the developer regions, the left developer chamber comprising at least one left developer drum and a left transport drum for transporting toner to the left developer drum, the right developer chamber comprising at least one right developer drum and a right transport drum for transporting toner to the right developer drum, the left and right developer chambers being separated by a partition, the partition comprising a first opening for accommodating a first coupling element that connects the left and right developer drums together and second opening for accommodating a second coupling agent for connecting the left and right transport drums together, the first opening also accommodating a first seal disposed between the partition and the first coupling element to prevent migration of toner through the first opening and between developer chambers, the second opening also accommodating a second seal disposed between the partition and the second coupling element to prevent migration of toner through the second opening and between developer chambers.

2. The developer station of claim 1 wherein the left developer drum comprises a left hollow drum that is connected to a left magnet stator, the right developer drum comprises a right hollow drum that is connected to a right magnet stator, the first coupling element comprises a tubular connecting member that passes through the first opening and connects the left hollow drum to the right hollow drum.

3. The developer station of claim 2 wherein the tubular connecting member comprises a left opposing end comprising a left lateral acceptance region that is received in the left hollow drum and a right opposing end comprising a right lateral acceptance region that is received in the right hollow drum as well as an inside running surface disposed between the left and right lateral acceptance regions, the inside running surface engaging a plurality radial seal elements which isolate the left and right opposing ends of the tubular connecting member from one another and prevent the migration of toner through the tubular connecting member.

4. The developer station of claim 3 wherein the left lateral acceptance region is threadably connected to the left hollow drum and the right lateral acceptance region is threadably connected to the right hollow drum.

5. The developer station of claim 3 wherein the running surface comprises an abrasion-resistant metal.

6. The developer station of claim 1 wherein the first coupling element comprises a tubular connecting member that connects the left developer drum to the left developer drum, the tubular member comprising an inside surface that engages a radial shaft seal comprising a seal member that comprises a plurality of elastic seal lips that prevent the migration of toner through the tubular connecting member.

7. The developer station of claim 1 wherein the first seal comprises a layer of elastic material disposed between the first coupling element and an acceptance region of the first opening.

8. The developer station of claim 1 wherein the first seal comprises a radial seal comprising Teflon felt.

9. The developer station of claim 1 wherein the left and right developer drums and the first coupling element are coaxial.

10. The developer station of claim 1 wherein the left and right transport drums and the second coupling element are coaxial.

11. The developer station of claim 1 wherein the second seal comprises a sealed bearing mounted around the second coupling element and between the second coupling element and the second opening.

12. The developer station of claim 1 wherein the second coupling element comprises an axle that is coaxial with the left and right transport drums, the second seal comprises a central collar that extends around the axle, the collar being disposed between a pair of spring washers, the collar and pair of spring washers being disposed between a pair of rolling bearings, the collar, pair of spring washers and pair of rolling bearings being disposed between a pair of seal rings, the seal rings each providing a seal between the axle an outer bearing member that engages the opening in the partition.

13. The developer station of claim 12 wherein the outer bearing member is secured against rotation by an anti-rotation element that connects the outer bearing member to a longitudinal guide, the longitudinal guide being connected to a stationary housing.

14. The developer station of claim 1 wherein left and right transport drums, second coupling element and second seal form a transport drum assembly can be removed from the developer station as a unit for service and replaced as a unit.

15. The developer station of claim 1 wherein the developer chambers are contained in a common housing, the developer chambers further being removable from the common housing for maintenance or replacement.

16. The developer station of claim 1 further comprising a left dosing drum and a right dosing drum, the partition comprising a third opening for accommodating a third coupling agent that connects the left dosing drum to the right dosing drum, the station further comprising a third seal disposed between the partition and the third coupling element to prevent migration of toner through the third opening.

17. The developer station of claim 1 further comprising a common drive for the developer and transport drums.

18. A developer station for a printer or copier device for a separate inking of at least two developer regions with toner, the separate developer regions being arranged side-by side on an electrographic intermediate carrier, the developer station comprising:

at least two developer chambers and including a left developer chamber and a right developer chamber arranged side-by-side, each of said developer chambers being in alignment with one of the developer regions, the left developer chamber comprising at least one left developer drum disposed between a left dosing drum and a left transport drum for transporting toner to the left developer drum, the right developer chamber comprising at least one right developer drum disposed between a right dosing drum and a right transport drum for transporting toner to the right developer drum, the left and right developer chambers being separated by a partition, the partition comprising a first opening for accommodating a first coupling element that connects the left and right developer drums together, a second opening for accommodating a second coupling agent for connecting the left and right transport drums together, and a third opening for accommodating a third coupling element for connecting the left and right dosing drums together, the first opening also accommodating a first seal disposed between the partition and the first coupling element to prevent migration of toner through the first opening and between developer chambers, the second opening also accommodating a second seal disposed between the partition and the second coupling element to prevent migration of toner through the second opening and between developer chambers, the third opening also accommodating a third seal disposed between the partition and the third coupling element to prevent migration of toner through the third opening and between developer chambers, the station further comprising a common drive for the dosing, developer and transport drums.

19. The developer station of claim 18 wherein the left developer drum comprises a left hollow drum that is connected to a left magnet stator, the right developer drum comprises a right hollow drum that is connected to a right magnet stator, the first coupling element comprises a tubular connecting member that passes through the first opening and connects the left hollow drum to the right hollow drum, the tubular connecting member comprises a left opposing end comprising a left lateral acceptance region that is threadably connected to the left hollow drum and a right opposing end comprising a right lateral acceptance region that is threadably connected to the right hollow drum as well as an inside running surface disposed between the left and right lateral acceptance regions, the inside running surface engaging a plurality radial seal elements which isolate the left and right opposing ends of the tubular connecting member from one another and prevent the migration of toner through the tubular connecting member.

20. The developer station of claim 18 wherein the second coupling element comprises an axle that is coaxial with the left and right transport drums, the second seal comprises a central collar that extends around the axle, the collar being disposed between a pair of spring washers, the collar and pair of spring washers being disposed between a pair of rolling bearings, the collar, pair of spring washers and pair of rolling bearings being disposed between a pair of seal rings, the seal rings each providing a seal between the axle an outer bearing member that engages the opening in the partition, the outer bearing member being secured against rotation by an anti-rotation element that connects the outer bearing member to a longitudinal guide, the longitudinal guide being connected to a stationary housing.

* * * * *